US007037145B2

(12) United States Patent
Fleming et al.

(10) Patent No.: US 7,037,145 B2
(45) Date of Patent: May 2, 2006

(54) ELECTRICAL CONTACT AND CONNECTOR

(75) Inventors: David Francis Fleming, Palmyra, PA (US); David Anthony Skotek, Harrisburg, PA (US); John Henry Weaver, Jr., Marietta, PA (US)

(73) Assignee: Tyco Electronics Corporation, Middletown, PA (US)

( * ) Notice: Subject to any disclaimer, the term of this patent is extended or adjusted under 35 U.S.C. 154(b) by 43 days.

(21) Appl. No.: 10/601,722

(22) Filed: Jun. 23, 2003

(65) Prior Publication Data

US 2004/0259427 A1 Dec. 23, 2004

(51) Int. Cl.
*H01R 13/415* (2006.01)

(52) U.S. Cl. ..... 439/741

(58) Field of Classification Search ..... 439/741, 439/877, 878, 880, 881, 709, 84, 743
See application file for complete search history.

(56) References Cited

U.S. PATENT DOCUMENTS

| | | | | |
|---|---|---|---|---|
| 2,445,587 | A * | 7/1948 | Sims | 336/192 |
| 2,755,453 | A * | 7/1956 | Cloutier | 439/741 |
| 2,869,107 | A * | 1/1959 | Engel | 439/82 |
| 2,947,964 | A * | 8/1960 | Johanson et al. | 439/62 |
| 3,492,628 | A * | 1/1970 | Matthews | 439/81 |
| 3,910,663 | A * | 10/1975 | Winger | 439/92 |
| 4,264,117 | A * | 4/1981 | Pritulsky | 439/419 |
| 4,299,436 | A * | 11/1981 | Ackerman | 439/853 |
| 5,064,379 | A * | 11/1991 | Ryll et al. | 439/81 |
| 5,772,454 | A * | 6/1998 | Long, Jr. | 439/83 |
| 6,193,567 | B1 * | 2/2001 | Hsieh | 439/853 |

* cited by examiner

*Primary Examiner*—Javaid H. Nasri

(57) ABSTRACT

An electrical contact is provided. The electrical contact includes a body with a top surface, a bottom surface, and side edges. The body includes a retention finger formed integral with the body and the retention finger is adapted to secure the body to a carrier. The carrier has at least one hole from the first surface to the second surface. The retention finger extends through at least one hole to engage the second surface of the carrier.

13 Claims, 6 Drawing Sheets

ELECTRICAL CONTACT AND CONNECTOR

BACKGROUND OF THE INVENTION

The invention relates generally to a power connector and more particularly to an electrical contact and connector configured for power distribution.

In the past, a variety of connectors have been utilized for power distribution applications. A wide variety of electrical connectors exist for use today depending upon the environment and application for which it is intended. In some applications, multiple sets of wires are needed to be joined by an electrical connector for a variety of applications. Examples of such applications may be found in residential or commercial environments, such as utility applications that utilize equipment with high power demands. An example of a commercial application with a high power demand is highway lighting.

In one example, conventional power connectors exist that include a housing or base with one or more contacts mounted to the housing or base with a rivet. Typically, the base is made out of a non-conductive material, such as Nomex™. The base is separately secured to a support structure, such as a transformer. The wires of the transformer are coupled to the contacts of the power connector to facilitate power distribution. However, conventional power connectors have met with limited success and have had difficulty keeping the contacts secured to the base. Conventional power connectors use a separate rivet to join each contact to the base.

However, the use of a separate rivet creates the potential for the contact to be disconnected if the rivet inadvertently dislodges. In addition, joining the contact to the base using a rivet is labor intensive and increases manufacturing costs and the number of parts in the connector.

BRIEF DESCRIPTION OF THE INVENTION

An electrical contact is provided. The electrical contact includes a body with a top surface, a bottom surface, and side edges. The body includes a retention finger formed integral with the body and the retention finger is adapted to secure the body to a carrier. The carrier has at least one hole extending between the first surface and the second surface. The retention finger extends through the one hole to engage the second surface of the carrier.

In another embodiment, an electrical connector is provided that includes an insulative carrier having a first surface and a second surface. The electrical connector further includes at least one contact having a body with a top surface, a bottom surface, and side edges. The bottom surface of the body is provided on the first surface of the carrier. The body includes at least a pair of lances formed integral with the body.

The lances are secured to the second surface of the carrier. Optionally, the lances may be crimped in a staple like manner through holes in the carrier to the second surface.

DETAILED DESCRIPTION OF THE INVENTION

Figure 1:
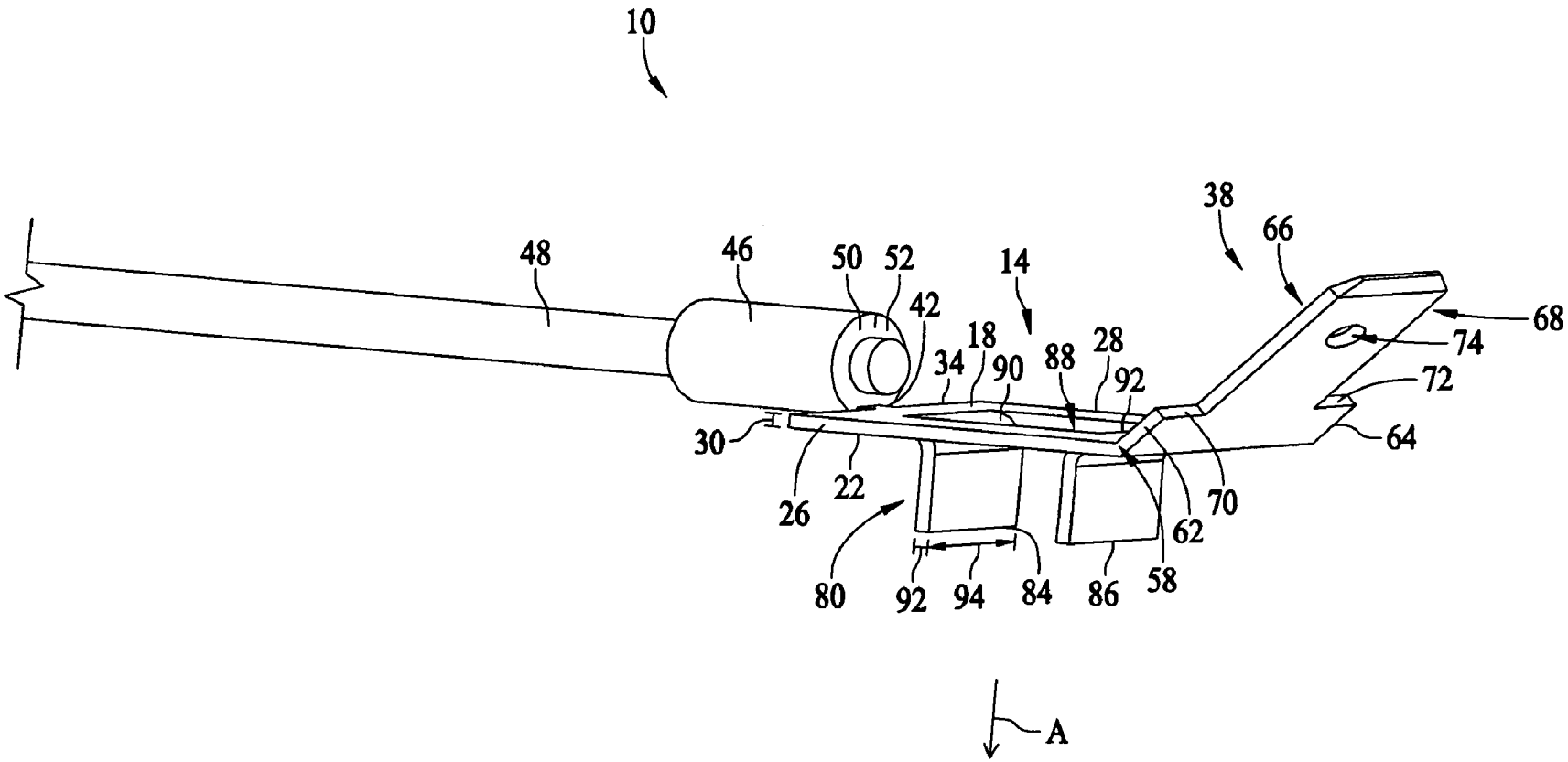
FIG. 1 is a perspective view of an electrical contact formed according to an embodiment of the present invention.

FIG. 1 is a perspective view of an electrical contact 10 formed according to an embodiment of the present invention. The contact 10 includes a body 14 having a planar top surface 18, a planar bottom surface 22, a pair of side edges 26 and 28, a rear edge 34, and a contact portion 38. The top and bottom surfaces 18 and 22 define a thickness 30.

Figure 2:
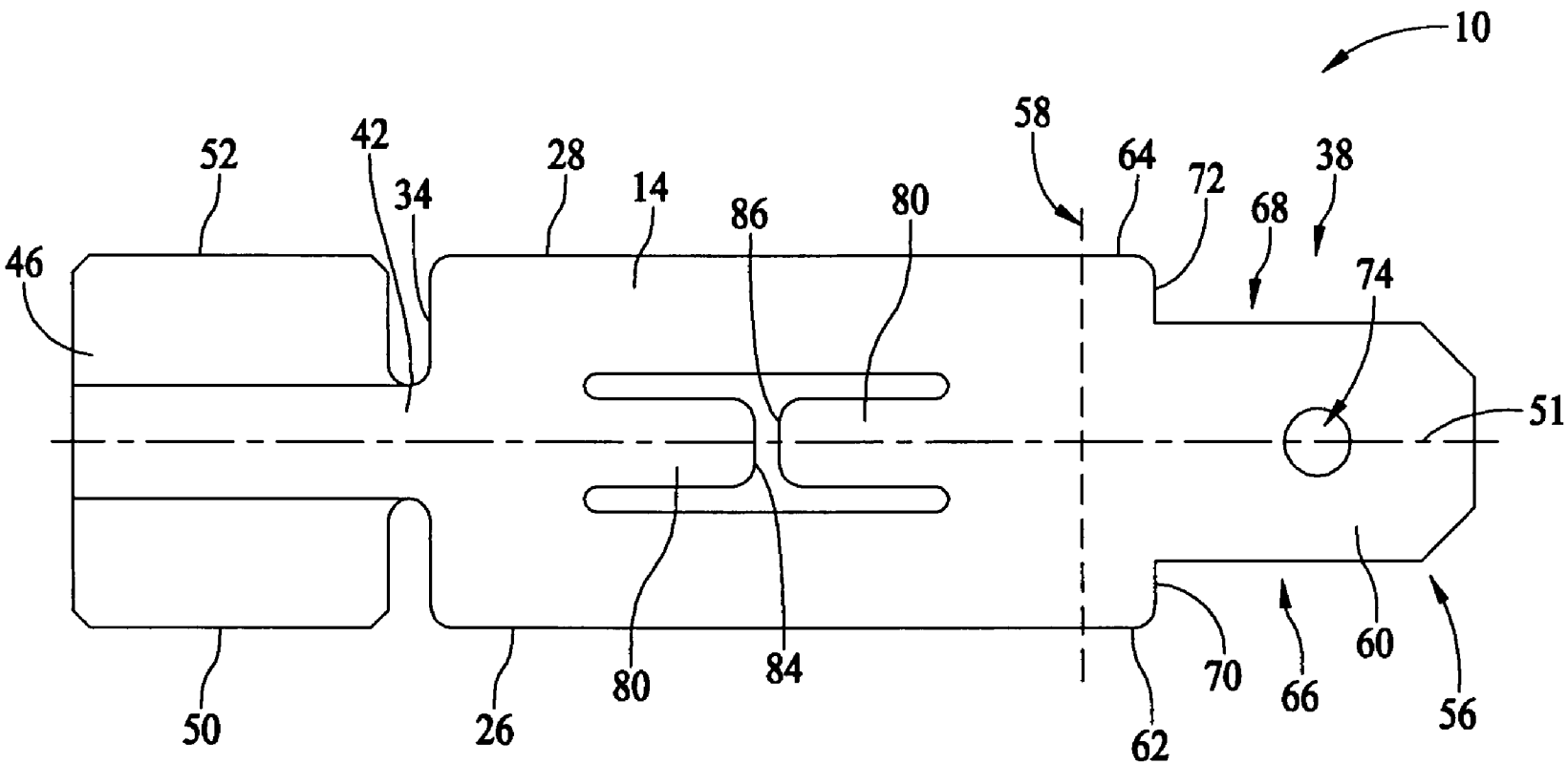
FIG. 2 is a top view of an electrical contact according to an embodiment of the present invention.

FIG. 2 is a top view of contact 10 after it has been stamped, but before being formed or bent to final shape. The body 14 is formed integral with a linkage portion 42 extending from the rear edge 34 to join a wire retainer 46 to the body 14. The wire retainer 46 is stamped in a generally planar arrangement with opposed ends 50 and 52 extending laterally from an axis 51. A wire 48 (without insulation) is aligned with the linkage portion 42 on the wire retainer 46 along the axis 51. Opposite ends 50 and 52 of the wire retainer 46 are bent or crimped around the wire 48.

The body is joined at the rear end 34 with the wire retainer 46 and at a bend 58 with the contact portion 38. Contact portion 38 includes a mating portion 56 formed with the body 14 at bend 58. The mating portion 56 is bent at an obtuse angle with respect to top surface 18. Optionally, the mating portion 56 may be aligned parallel with the body 14. Alternatively, the mating portion 56 may be provided along either of the side edges 26 and 28 of the body 14.

The mating portion 56 is a contact blade. Alternatively, the mating portion 56 may be a contact pin. As shown in FIGS. 1 and 2, the mating portion 56 is a faston type contact having side edges 62 and 64 cut to include notches 66 and 68 that define ridges 70 and 72. The mating portion 56 also has an opening 74 therethrough for mating with a female connector faston (not shown). Optionally, mating portion 56 may be joined directly with a wire, such as by inserting the wire directly through the opening 74 without an intervening receptacle contact.

The body 14 includes at least one retention finger 80 formed integral therewith. A pair of retention fingers 80 are stamped from the interior of the body 14. The pair of retention fingers 80 are bent or crimped so that ends 84 and 86, respectively, extend in a direction perpendicular to the bottom surface 22 of the body 14 in a direction indicated by arrow A. When retention fingers 80 are bent in the direction of arrow A, a hole 88 is formed within body 14. Retention fingers 80 are provided integrally with body 14 at bends 90 and 92 provided at opposite ends of the hole 88. The bent retention fingers 80 are formed as lances.

Optionally, more than two retention fingers 80 may be stamped from the body 14. The retention fingers 80 may be triangularly or otherwise shaped. Alternatively, at least one retention finger 80 may be provided integrally to the body 14 at one of the side edges 26 and 28 of the body 14. In an alternative embodiment, retention finger 80 may have a variable thickness. For example, the thickness 92 could be gradually decreased from the bend 90 to the distal end of retention finger 80 until forming a knife like edge. In another embodiment, retention finger 80 may have a variable thickness 92 and width 94 such that the thickness 92 and width 94 could be gradually decreased to a form a pin.

Figure 3:
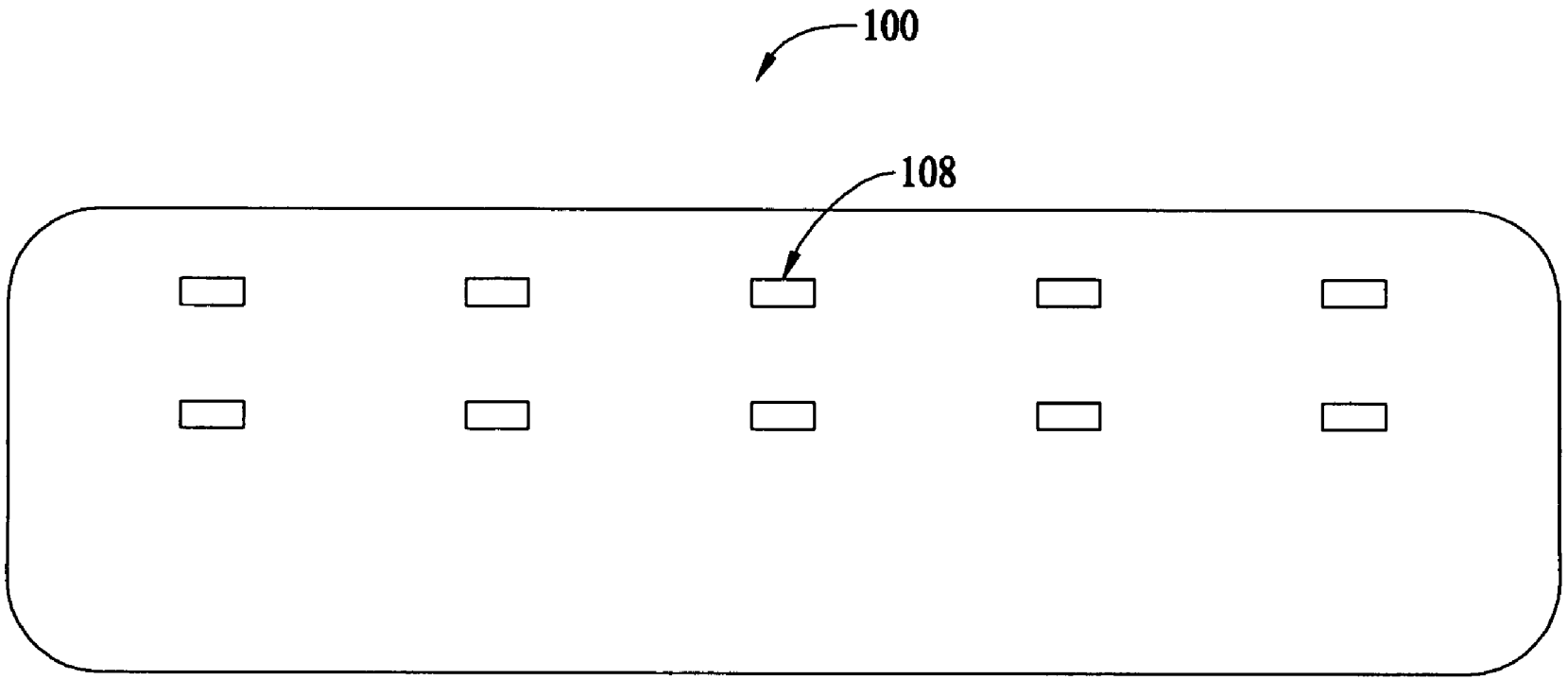
FIG. 3 is a top view of a carrier formed according to an embodiment of the present invention.

FIG. 3 is a top view of a board or carrier 100 to be joined to contact 10, which carrier 100 is shown to be substantially elongate. Optionally, carrier 100 may be of other shapes. As illustrated, carrier 100 has at least one pair of openings 108 therethrough. The openings 108 are oriented such that at least two openings 108 are in alignment for receiving two corresponding retention fingers 80. In an alternative embodiment, the openings 108 may be a single opening sized to receive both retention fingers 80. In an alternative embodiment, the opening 108 may be a single opening sized to receive both retention fingers 80.

Optionally, a pair of openings 108 may be staggered with respect to another pair of openings 108. Optionally, the plurality of openings 108 may be positioned in various patterns to accommodate various contact configurations on carrier 100. Carrier 100 may have openings 108 of various shapes, such as circular or triangular. Carrier 100 may have at least one opening 108 having a different size than another opening 108. Optionally, carrier 100 may have at least one perforation defining an opening 108 configured to be partially or completely released from the carrier 100 upon an application of force, such as insertion of a retention finger 80. Optionally, carrier 100 comprises a non-conductive material, such as Nomex™.

Figure 4:
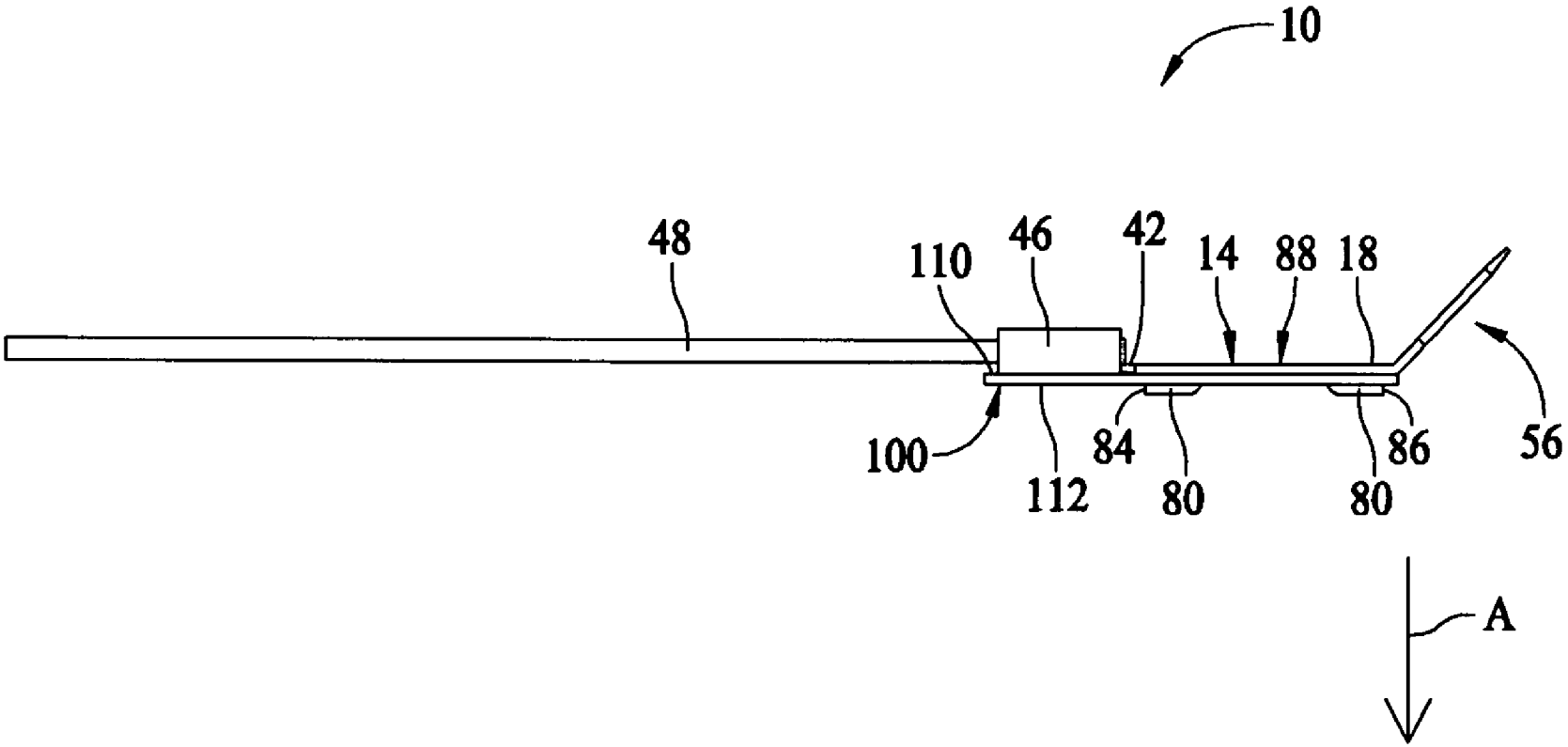
FIG. 4 is a side view of the electrical contact coupled to the carrier by at least one retention finger.

FIG. 4 is a side view of a connector assembly having a contact 10 coupled to carrier 100 by retention fingers 80. The carrier 100 has a first surface 110 and a second surface 112. The bottom surface 22 of body 14 of the contact 10 is positioned on the first surface 110 of carrier 100. At least one retention finger 80, which extends substantially perpendicular to the bottom surface 22 of the body 14, is inserted through at least one opening 108 of the carrier 100 in the direction of arrow A. Retention finger 80 is deformed or crimped to engage the second surface 112 of carrier 100 securing the body 14 to carrier 100. As shown in FIG. 4, both ends 84 and 86 of retention fingers 80 face away from each other. Each retention finger 80 is in contact with the second surface 112 of carrier 100 along substantially the length of each retention finger. Optionally, at least one retention finger 80 extends from either of side edges 26 and 28 and is bent around the carrier 100 to engage the second surface 112 of the carrier 100 without extending through the holes 88 of carrier 100.

Figure 5:
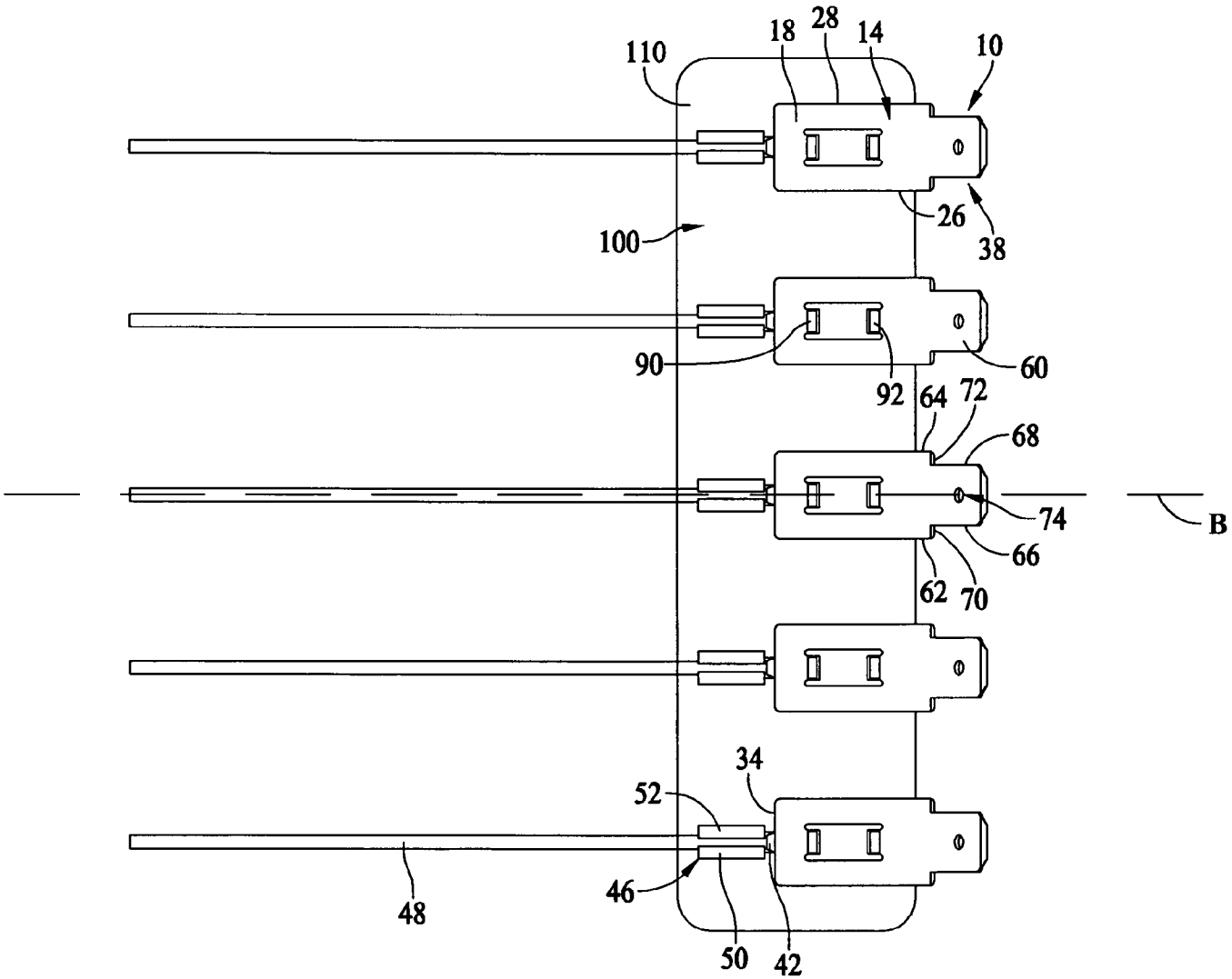
FIG. 5 is a top view of a plurality of electrical contacts mounted to the carrier according to an embodiment of the present invention.

FIG. 5 is a top view of a plurality of contacts 10 mounted to carrier 100 according to an embodiment of the present invention. Each contact 10 is secured to carrier 100 by its respective retention fingers 80. Optionally, contact 10 may be arranged such that the axis 51 of at least one contact forms an acute angle with respect to axis B. Thus, the plurality of contacts would be arranged in a flared configuration with respect to axis B.

Figure 6:
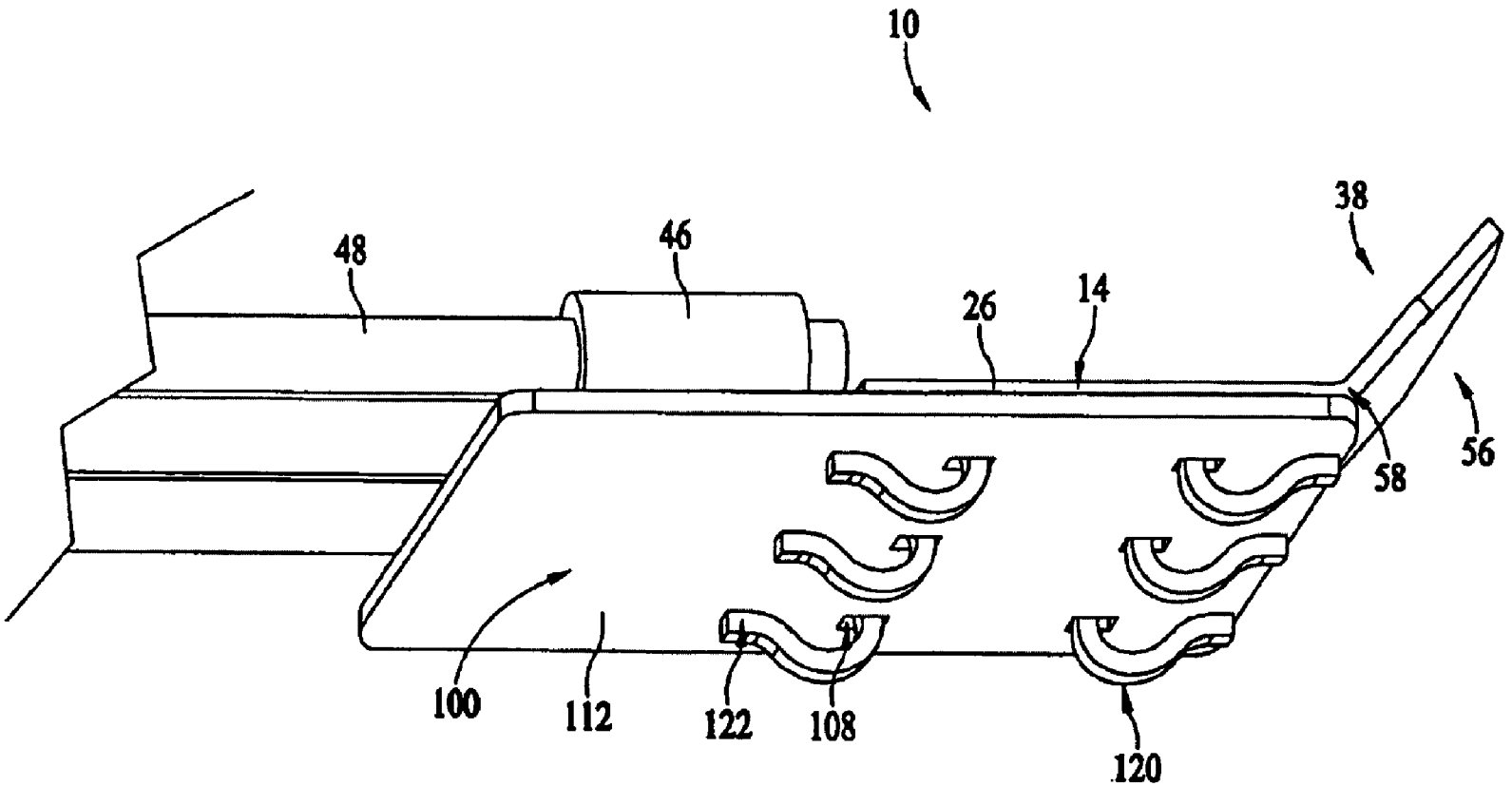
FIG. 6 is a bottom perspective view of a plurality of electrical connectors mounted to the carrier according to an embodiment of the present invention.

FIG. 6 is a bottom perspective view of a plurality of contacts 10 mounted to carrier 100. As shown in FIG. 6, retention fingers 120 are arcuate such that only a distal portion 122 of each retention finger 120 are in contact with the second surface 112 of carrier 100. Optionally, retention fingers 80 may be crimped in a staple like manner such that each end 84 and 86 faces away from each other.

While the invention has been described in terms of various specific embodiments, those skilled in the art will recognize that the invention can be practiced with modification within the spirit and scope of the claims.

What is claimed is:

1. An electrical contact comprising a body with a top surface, a bottom surface, and opposing side edges, said body including opposing first and second retention fingers formed integrally with said body and having respective distal ends, said first and second retention fingers positioned between the side edges and the respective distal ends being separated from one another, each of said first and second retention fingers adapted to secure said body to a single surface of an insulative carrier when said first and second retention fingers are inserted through the carrier and crimped into engagement with said carrier, wherein said distal ends of said first and second retention fingers face away from one another when crimped to said carrier.

2. The electrical contact according to claim 1 wherein the body defines a longitudinal axis, the body further comprising a wire retainer extending from said body along the longitudinal axis, said wire retainer configured to receive a wire along the longitudinal axis and parallel to the single surface of the carrier.

3. The electrical connector according to claim 1 further comprising a mating portion joined to said body.

4. The electrical connector according to claim 3 wherein said mating portion is a faston type mating portion.

5. The electrical connector according to claim 1 wherein said first and second retention fingers comprise opposing lances extending perpendicular to a surface of said carrier.

6. The electrical connector according to claim 1 wherein said carrier includes a first surface, a second surface and first and second holes extending therebetween, each of said holes receiving a respective one of said opposing first and second retention fingers.

7. The electrical connector according to claim 1 wherein said first and second retention fingers are stamped from an interior of said body.

8. The electrical connector according to claim 1 wherein at least one of said first and second retention fingers comprises an arcuate portion extending between the body and the respective distal end of the at least one retention finger, and further wherein the arcuate portion is spaced from the carrier such that only the distal end of the at least one retention finger is in contact with the single surface of the carrier.

9. An electrical connector comprising at least one contact having a substantially planar body with a top surface, a bottom surface, and side edges, said body including at least a pair of lances formed integrally with said substantially planar body and extending at an angle from said substantially planar body, said lances being spaced from one another and spaced from the side edges, said lances configured to secure said body to an insulative carrier, said carrier including a first surface and a second surface, said bottom surface of said body provided on said first surface of said carrier and extending substantially parallel to the first surface;

wherein said lances are crimped to said second surface.

10. The electrical connector according to claim 9 further comprising a wire retainer extending from said substantially planar body along a longitudinal axis thereof said wire retainer configured to receive a wire extending substantially parallel to the first surface.

11. The electrical connector according to claim 9 further comprising a mating portion joined to said body.

12. The electrical connector according to claim 9, wherein said lances are stamped from said body in faced relation with each other, and said lances are bent substantially perpendicular to said bottom surface.

13. The electrical connector according to claim 9 wherein said carrier has at least a pair of holes extending front said first surface to said second surface, each of said lances extend through one of said holes to engage said second surface of said carrier.

* * * * *